US005240260A

United States Patent [19]

Strongin

[11] Patent Number: 5,240,260

[45] Date of Patent: Aug. 31, 1993

[54] TOY GAME APPARATUS

[75] Inventor: Ned Strongin, New York, N.Y.

[73] Assignee: Hasbro, Inc., Pawtucket, R.I.

[21] Appl. No.: 4,101

[22] Filed: Jan. 13, 1993

[51] Int. Cl.[5] ..... A63F 9/00

[52] U.S. Cl. ..... 273/445; 446/175; 273/450

[58] Field of Search ..... 273/450, 447, 448, 445, 273/446; 446/175, 298

[56] References Cited

U.S. PATENT DOCUMENTS

| | | | |
|---|---|---|---|
| 3,490,172 | 1/1970 | Schwartz | 446/298 |
| 3,604,705 | 9/1971 | Hawthorne | 273/447 |
| 3,614,106 | 10/1971 | Morrison et al. | 273/450 |
| 3,785,647 | 1/1974 | Bender | 273/450 |
| 4,903,424 | 2/1990 | Satoh et al. | 446/175 X |
| 4,995,606 | 2/1991 | Kashimoto | 273/447 |

*Primary Examiner*—Paul E. Shapiro

*Attorney, Agent, or Firm*—Salter, Michaelson & Benson

[57] ABSTRACT

A toy game apparatus includes a plurality of independent character figure body portion segments which are rotatably received on a bent rod so that they extend upwardly from a base and a plurality of upwardly facing, hand-like ball receiving elements on each of the body portion segments. The apparatus further includes a sound responsive operating mechanism for rotating the bent rod to shift the body portion segments back and forth in response to a predetermined level of sound. The apparatus is operative in an amusement game wherein game players are required to assemble balls in the ball receiving elements and wherein talking or laughing sounds produced by game players cause the operating mechanism to rotate the bend rod to shift the body portion segments back and forth.

9 Claims, 3 Drawing Sheets

TOY GAME APPARATUS

BACKGROUND AND SUMMARY OF THE INVENTION

The instant invention relates to amusement games and more particularly to a toy game apparatus which is adapted for use in an interesting and challenging action game.

Various types of toy game apparatus have been heretofore available for use by children in action games. In this regard, it has been found that game apparatus which challenge the manual dexterity of children often have high levels of play value. Game apparatus which involve competition among game players have also frequently been found to be quite popular. Further toy game apparatus of these types which incorporate unusual action character figures have often been found to be even more popular.

The instant invention provides an effective action toy game apparatus which is adapted for use by young children in an exciting an interesting amusement game. More specifically, the instant invention provides an action toy game apparatus comprising a plurality of body segments which cooperate to define an amusing action character figure, wherein the body segment are rotatably received on a bent rod so that they are shifted from side to side when the rod is rotated. The apparatus further comprises a plurality of hand-like elements on each of the body segments which are adapted for receiving marbles or small balls therein, as positioned by game players and a sound responsive drive mechanism which is operative for rotating the rod to shift the body segments relative to one another in response to a predetermined level of sound, as produced by game players.

Still more specifically, the action toy game apparatus of the instant invention comprises a plurality of balls, a base adapted to be received on a supporting surface, an elongated bent rod extending upwardly from the base and a plurality of character figure body segments rotatably received on the rod which cooperate to define an action character figure body. In this regard, adjacent body segments are preferably nonrotatably received in engagement with each other, and they are preferably maintained in nonrotatable relation to the base. The toy game apparatus further comprises ball receiving means extending outwardly from each of the body segments for receiving and supporting balls thereon, rotating means in the base for rotating the rod relative to the base and sound responsive actuating means for actuating the rotating means to rotate the rod. The apparatus preferably comprises a plurality of the ball receiving means extending outwardly from each of the body segments, and the ball receiving means are preferably formed as upwardly opening hand-like elements on the body segments. The toy game apparatus preferably comprises four of the hand-like elements on each of the body segments, and the hand-like elements are preferably positioned in four vertical rows. Further, the base preferably includes four tray sections, each of which is positioned beneath one of the vertical rows of hand-like elements. The balls are preferably formed in four different colors, and the game apparatus preferably further includes a plurality of tongs for enabling game players to grasp the balls and place them in the hand-like elements.

Accordingly, for use in operation of the toy game apparatus of the subject invention each game player (up to four) is given a plurality of balls of a predetermined color which are positioned in one of the tray sections in the base. Thereafter, game play is commenced and each game player is required to attempt to assemble his or her balls or marbles in the hand-like elements of the character figure segments positioned above the respective tray section thereof. However, in the event that a game player makes a noise, such as by giggling or laughing, the rotating means in the base is automatically actuated for rotating the bent rod which causes the character figure segments to be shifted relative to one another so that the action character figure embodied in the game begins to wiggle or move back and forth. When this occurs, it becomes more difficult for game players to position their balls or marbles in the hand-like elements, and some of the balls or marbles already received in the hand-like elements may fall into the respective trays therebeneath. In any event, the first player who is able to position all of his or her balls in the appropriate hand-like elements is the game winner.

Accordingly, it is a primary object of the instant invention to provide an effective action toy game apparatus comprising an animated action character figure.

Another object of the instant invention is to provide an amusing action toy game apparatus wherein game players are required to assemble balls in movable ball receiving elements.

Another object of the instant invention is to provide an effective action toy game apparatus which is sound responsive for impeding the progress of game players.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
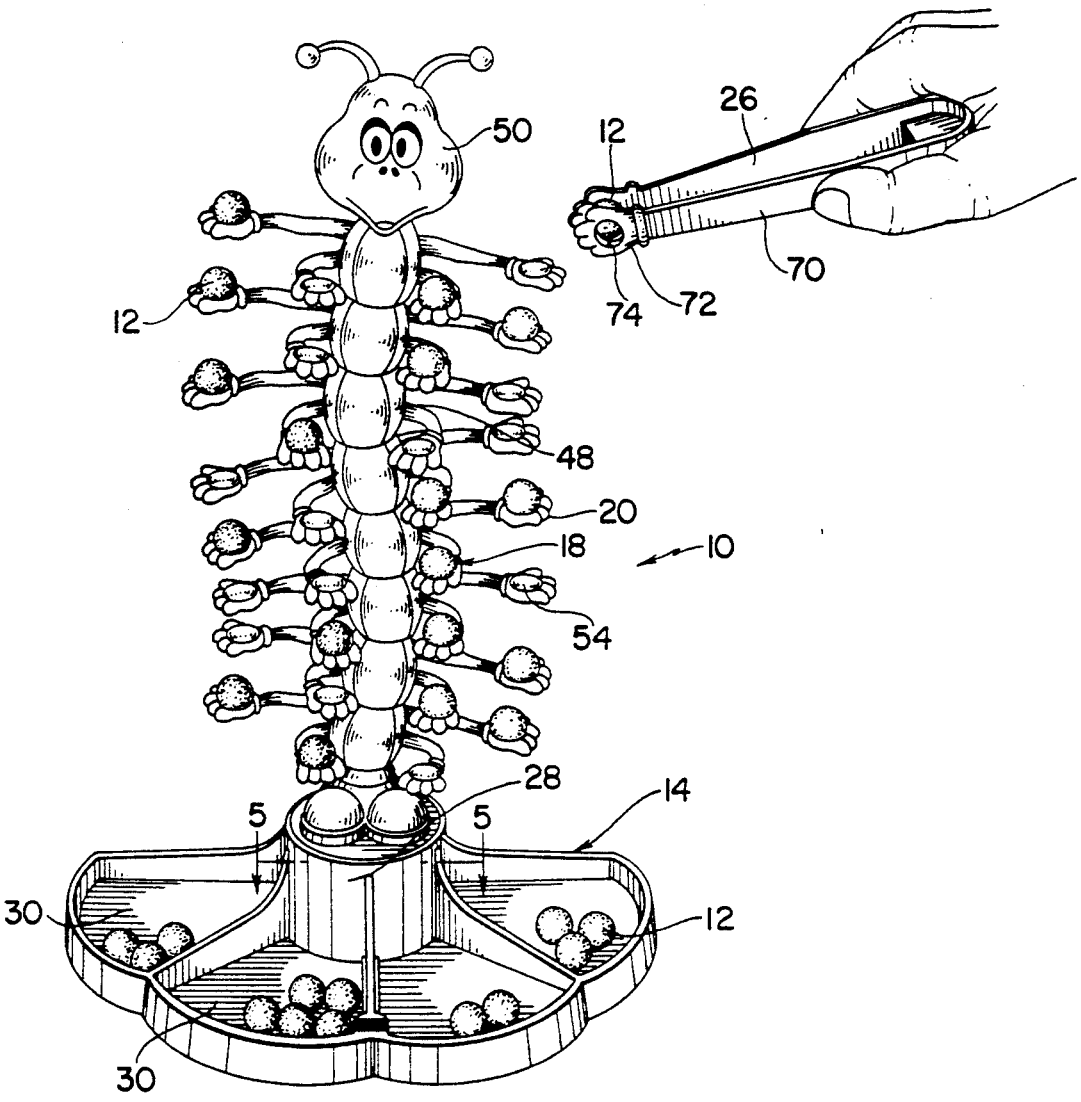
FIG. 1 is a perspective view of the toy game apparatus of the instant invention as operated by a game player.

Referring now to the drawings, the toy game apparatus of the instant invention is illustrated in FIGS. 1 through 6 and generally indicated at 10 in FIG. 1. The toy game apparatus 10 comprises a plurality of balls 12, a base portion generally indicated at 14, a bent rod 16 extending upwardly from the base portion 14, and a character figure assembly generally indicated at 18 having a plurality of ball receiving elements 20 thereon. The toy game apparatus 10 further comprises a rotating mechanism generally indicated at 22, a sound responsive actuating mechanism 24 and a plurality of tongs 26. The actuating mechanism 24 is responsive to sound of a predetermined level for actuating the rotating mechanism 22 in order to animate the action character figure embodied in the body portion 18. The tongs 26 are operable by a game player for grasping the balls or marbles 12 and placing them in the ball receiving elements 20.

The balls 12 comprise relatively small balls or marbles, and they are preferably formed in equal quantities of four different colors. Accordingly, when the game apparatus 10 is utilized in an action game wherein game players are required to place the balls 12 on the ball receiving elements 20, it is possible for up to four game players to participate in game play.

Figure 3:
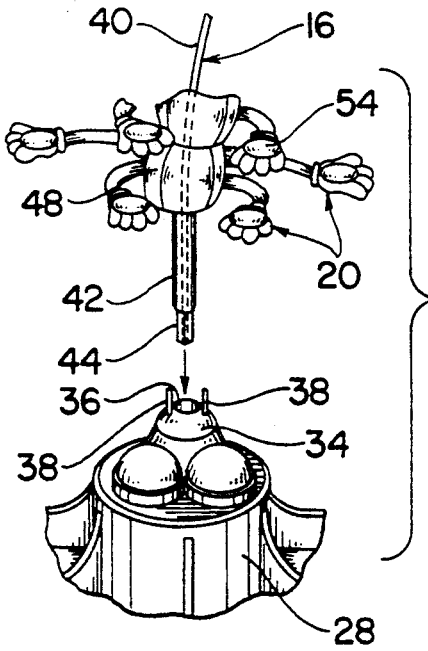
FIG. 3 is a fragmentary exploded perspective view of the lower portion of the game apparatus.
Figure 4:
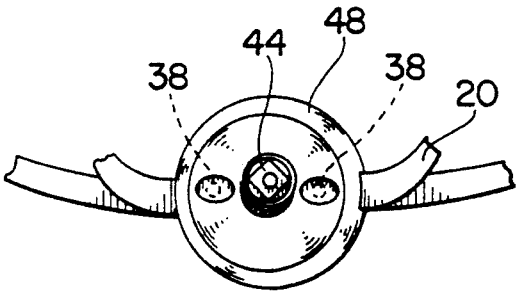
FIG. 4 is a bottom plan view of the lowermost body segment of the apparatus.

The base 14 is illustrated in FIGS. 1, 3, 5 and 6, and it includes a center housing or hub portion 28 in which the rotating mechanism 22 is mounted and a plurality of tray sections 30 which extend radially outwardly from the hub portion 28. Integrally formed in the forward portion of the base 14 is an actuating mechanism housing 32 for housing the actuating mechanism 24 in the manner illustrated in FIG. 1. As illustrated in FIG. 3, the center hub portion 2 includes a character figure receiving element 34 of convex configuration. The element 34 has a central aperture 36 therein, and it further includes a pair of upstanding pins 38 adjacent opposite sides of the aperture 36.

The bent rod 16 includes an elongated wire element 40, which is gradually and slightly bent along its length, and an enlarged lower end portion 42, which is nonrotatably received on the lower end of the wire element 40 and terminates in a lower end portion 44 of noncircular cross section. The bent rod 16 further comprises an upper element 46 which is nonrotatably received on the wire element 40 and rotatably received in the upper head portion of the action character figure embodied in the character FIG. 18.

Figure 2:
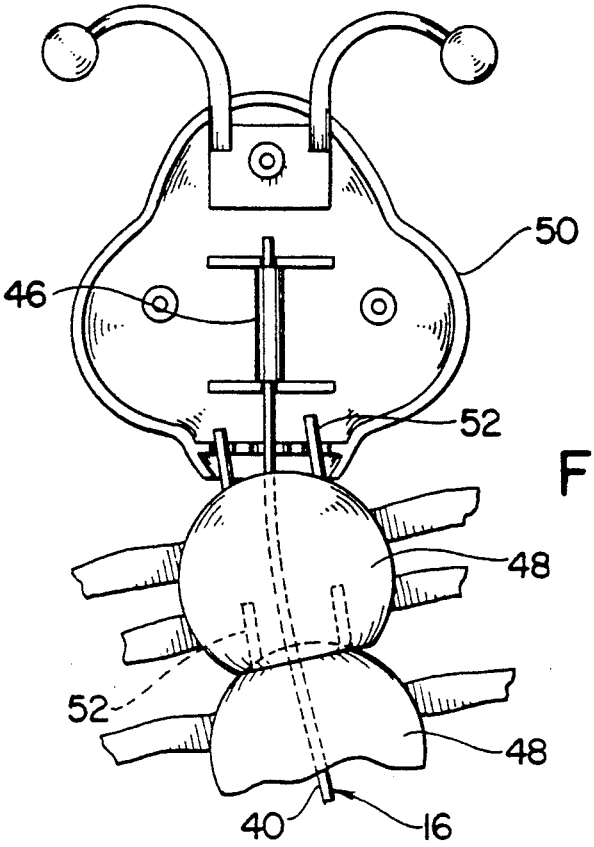
FIG. 2 is an enlarged fragmentary rear elevational view of the top portion of the game apparatus.

The action character FIG. 18 comprises a plurality of body segment 48, which are received and assembled on the bent rod 60, and a character figure upper head portion 50. Each of the body segments 48 has four of the ball receiving elements 20 formed thereon, and, as illustrated in FIG. 2, each of the body segments is received in loose but nonrotatable engagement with each of the adjacent body segments 48. Specifically, each of the body segments 48 includes a pair of pins 52 which are loosely received in corresponding apertures (not shown) in the lower end of the body segment 48 thereabove, and the upper most body segment 48 includes a pair of pins 52 which are loosely received in a pair of corresponding apertures (not shown) in the head portion 50. The head portion 50 comprises mating front and rear halves which cooperate to rotatably capture the upper end element 46 of the bent rod 16 in the manner illustrated in FIG. 2. The body segments 48 and the head portion 50 are maintained in assembled relation by the bent rod 16 which is rotatably received in the body segments 48 and the head portion 50 but longitudinally retained in position by the upper end portion 46 and the lower end portion 42. Accordingly, the bent rod 16 is rotatable relative to the body portion 18 to cause the body portion segments 48 to move from side to side and tilt slightly as the bent wire element 40 is rotated therein. Further, as illustrated in FIG. 3, the lower end portion 42 of the bent rod 16 is receivable in the aperture 36 in the base portion 28 and the lowermost body portion segment 48 is receivable on the mating section 34 so that the pins 38 are received in the corresponding apertures (not shown) in the lowermost body portion section 48. Hence, when the lower end portion 42 is received in the base portion 28 the body portion 18 is loosely retained in a generally vertical disposition but maintained in nonrotatable relation to the base 14 by the pins 38.

The ball receiving elements 20 are preferably formed as hand-like elements which extend outwardly from the body portion segments 48, as illustrated in FIG. 1. The ball receiving elements 20 preferably have upwardly facing recesses 54 formed therein which are dimensioned for receiving and supporting the balls 12 in a manner which normally retains the balls 12 in position on the receiving elements, but which nevertheless permits the balls 12 to be dislodged from the recesses 54 when the body portion segments 48 are moved relative to one another by the bent rod 16. Each of the body portion segments 48 preferably has four of the ball receiving elements 20 formed thereon, and the ball receiving elements 20 are preferably oriented in generally vertical rows of ball receiving elements 20, each of which is preferably aligned approximately above a different tray section 30. Accordingly, when balls 12 are dislodged from the ball receiving elements 20 as the bent rod 16 is rotated, the balls 12 normally fall into the trays 30 positioned therebeneath. As a result, when each of the game players is using balls of a different color, the balls of each game player can be initially positioned in a different tray 30 and then assembled on the ball receiving elements 20 thereabove so that as the balls 12 fall from the ball receiving elements 20, they normally fall into the appropriate trays 30.

Figure 5:
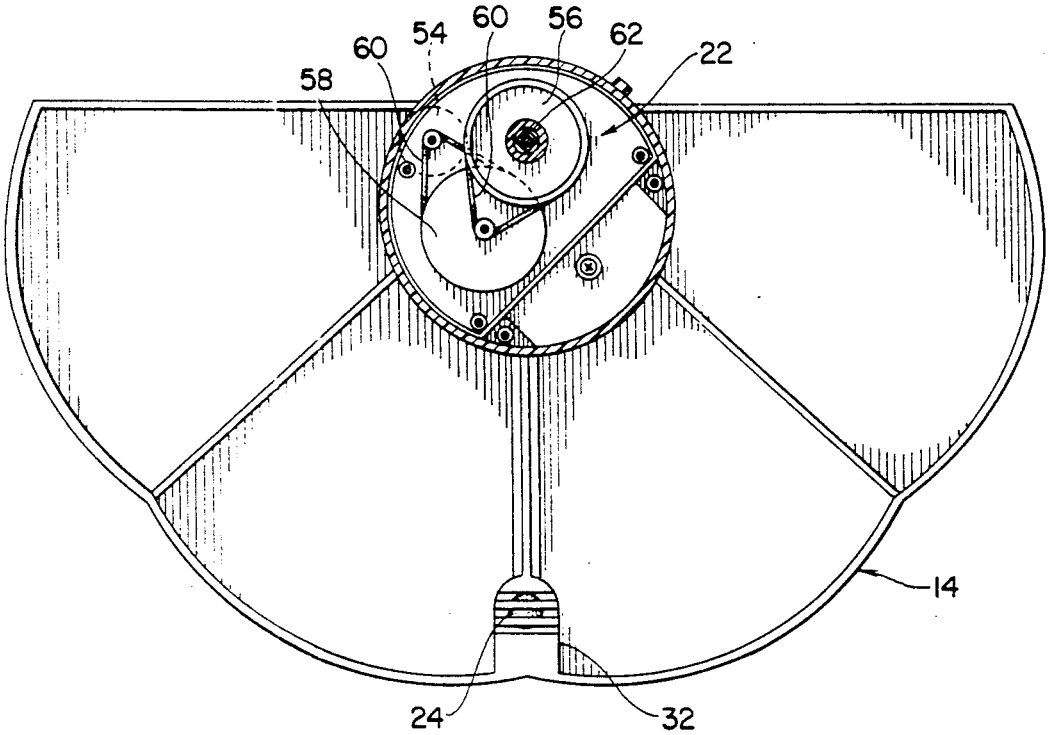
FIG. 5 is a sectional view taken along line 5—5 in FIG. 1.
Figure 6:
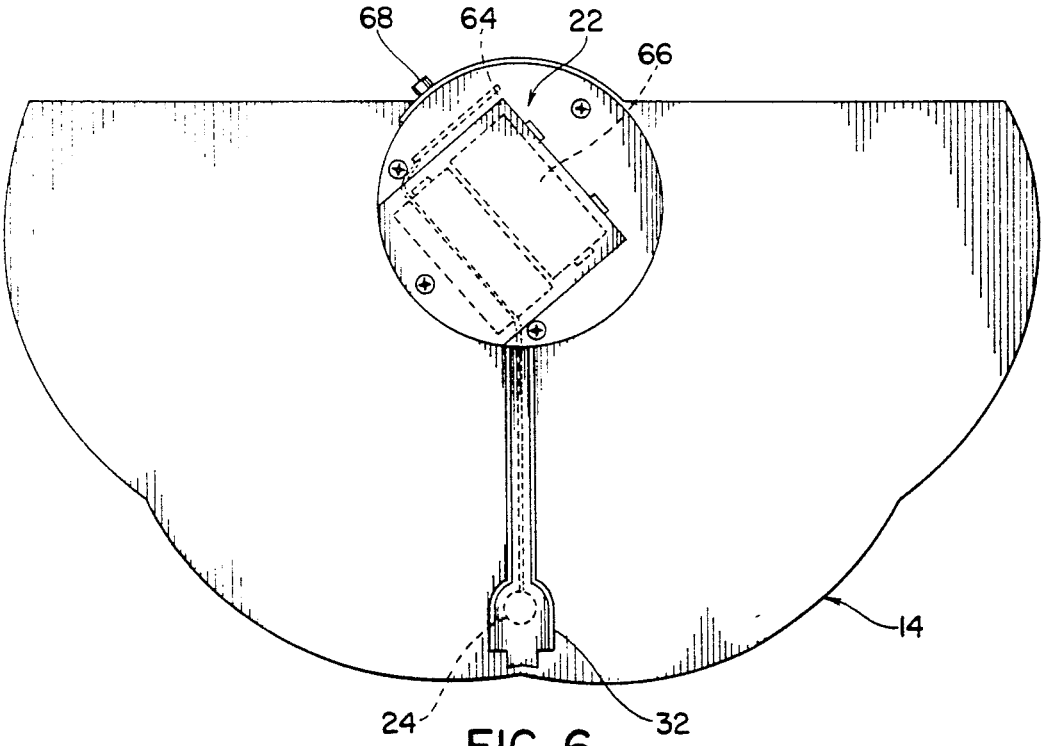
FIG. 6 is a bottom plan view of the game apparatus.

The rotating mechanism 20 is illustrated most clearly in FIGS. 5 and 6, and it comprises a drive motor 54 which is connected to a main drive pulley 56 through an intermediate drive pulley 58, and a pair of drive belts 60. The main drive pulley 56 has an aperture 62 therein of non-circular crofiguration to corresponds to the lower end portion 44 of the bottom element 42 of the bent rod 16. The drive mechanism 22 further comprises a battery housing 64 containing a pair of batteries 66 and an on/-off switch 68. The batteries 66 are electrically connected to the motor 54 for driving the motor 54 when the switch 68 is in an "on" position and the actuating mechanism 24 is in an "actuated" condition.

The actuating mechanism 24 comprises a conventional sound actuated switch which is connected to the rotating mechanism 22 for actuating the rotating mechanism 22 when the switch 68 is in an "on" position. The actuating mechanism 24 is responsive to a predetermined level of sound, such as produced by children giggling or the like, for actuating the rotating mechanism 22 to rotate the bent rod 16.

The tongs 26 comprise a pair of intergrally connected resilient arms 70 which terminate and hand-like members 72 having apertures 74 therein. The tongs 26 are adapted for individually grasping the balls 12 between the hand portions 72 so that a ball 12 so grasped is oriented in the hand portions 72 by the apertures 74. The tongs 26 are further operative for individual placing the balls 12 in the recesses 54 of the ball receiving elements 20 in the manner illustrated in FIG. 1.

The game apparatus 10 is adapted to be incorporated into an amusing and interesting game in which up to four game players are required to attempt to place the balls 12 in the recesses of the game receiving elements 20. Specifically, each game player is allocated a quantity of balls 12 of a particular color, which are placed in one of the tray sections 30, and a pair of tongs 26. Game play is then commenced, and each game player must use his or her tongs 26 to position his or her balls 12 in the game receiving elements 20 located above his or her tray section 30. In the event that one or more the game players makes a noise, such as a giggling sound, or talking, the sound is detected by the actuating mechanism 24 which actuates the rotating mechanism 22 to rotate the bent rod 16. This causes the character figure segments 48 to be shifted relative to one another, and in some instances it causes at least some of the balls 12 positioned in the ball receiving elements 20 to be dislodged so that they fall into the respective tray sections 30 therebeneath. As game players continue to attempt to place their balls 12 into the appropriate ball receiving elements 20, each player must compete to be the first player to assemble all of his or her balls in the appropriate recesses 54 in order to win the game.

It is seen therefore that the instant invention provides an effective and amusing toy game apparatus. The ball receiving elements 20 are adapted for receiving the balls 12 therein, and the actuating mechanism 24 is sound responsive for actuating the rotating mechanism 22 to rotate the bent rod 16 to animate the action character figure embodied in the body portion 18. This makes it more difficult to assemble the balls 12 in the recesses 54, and it may cause some of the balls 12 previously assembled therein to fall to the respective tray sections 30 therebeneath. Hence, it is seen that the toy game apparatus of the instant invention can be effectively incorporated into an interesting and challenging amusement game, and that it therefore has a high level of play value. Hence, the game apparatus 10 represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy game apparatus comprising:

a) a plurality of balls;

b) a base adapted to be received on a supporting surface;

c) an elongated bent rod extending upwardly from said base;

d) a plurality of character figure body segments loosely received on said rod, said body segments cooperating to define a character figure body and being rotatable relative to said rod;

e) ball receiving means extending outwardly from each of a plurality of said body segments, each of said ball receiving means facing upwardly and being adapted for receiving and supporting one of said balls thereon;

f) rotating means in said base actuatable for rotating said rod relative to said base; and g) actuating means responsive to a predetermined level of sound for actuating said rotating means.

2. In the toy game apparatus of claim 1, adjacent ones of said character figure body segments being nonrotatably received in engagement with each other, said character figure body segments including a lowermost segment which is nonrotatably received in engagement with said base.

3. In the toy game apparatus of claim 1, said ball receiving means extending outwardly from each of said body segments.

4. In the toy game apparatus of claim 1, said ball receiving means comprising a plurality of upwardly opening hand-like elements extending outwardly from said body segments.

5. In the toy game apparatus of claim 4, said ball receiving means comprising four of said hand-like elements extending outwardly from each of said body segments.

6. In the toy game apparatus of claim 5, said base including four tray sections.

7. In the toy game apparatus of claim 6, said hand-like elements being disposed in four vertical rows, each of said rows being disposed above a different one of said tray sections.

8. In the toy game apparatus of claim 7, said balls comprising balls of four different colors.

9. The toy game apparatus of claim 1 further comprising a plurality of tongs for grasping said balls and placing them in said ball receiving means.

* * * * *